US005161583A

United States Patent [19]

Ackerman

[11] Patent Number: 5,161,583

[45] Date of Patent: Nov. 10, 1992

[54] CLIP SECURING APPARATUS

[76] Inventor: David Ackerman, 2 Hilltop Cottages, Pulham, Nr. Dorchester, Dorset DT2 7DX, England

[21] Appl. No.: 743,466

[22] Filed: Aug. 9, 1991

[51] Int. Cl.[5] ..... B21F 15/06

[52] U.S. Cl. ..... 140/93 A; 29/243.56; 72/410

[58] Field of Search ..... 140/57, 93 A, 93 D, 140/123; 29/243.56; 53/138.4; 72/410

[56] References Cited

U.S. PATENT DOCUMENTS 4,556,058 12/1985 Green ..... 29/243.56
4,683,920 8/1987 Furutsu ..... 140/93 A

FOREIGN PATENT DOCUMENTS

WO86/0203 4/1986 PCT Int'l Appl. .
912591 12/1962 United Kingdom .
2165559A 4/1982 United Kingdom .
2200072A 7/1988 United Kingdom .
2201651A 9/1988 United Kingdom .

*Primary Examiner*—Lowell A. Larson
*Attorney, Agent, or Firm*—Andrus, Sceales, Starke & Sawall

[57] ABSTRACT

Clip securing apparatus for securing clips of plastics materials around filamentary, stranded or strip-like materials comprises a throat (25) for receiving materials to be secured together, a holder (14) for a plurality of clips, and a reciprocal driver (10) operable to remove clips one at a time from the holder (14) and to drive each clip in open condition through the throat (25) of the apparatus so that the materials to be secured together enter the clip. The throat (25) has opposed faces that act upon the clip as it passes through the throat (25) to close the clip around the materials and so secure the clip around the materials.

5 Claims, 3 Drawing Sheets

CLIP SECURING APPARATUS

This invention relates to clip securing apparatus for securing clips of plastics material around filamentary, stranded or strip-like materials, or combinations of such materials, a particular example being the component materials of plastics netting.

The component materials of plastics netting have been secured to one another to form the netting by clips of aluminum made secure around the component materials. It is desirable to use, instead, clips of plastics materials but apparatus for securing aluminum clips can not be used for securing plastics clips as a different closing action is required.

Figure 1:
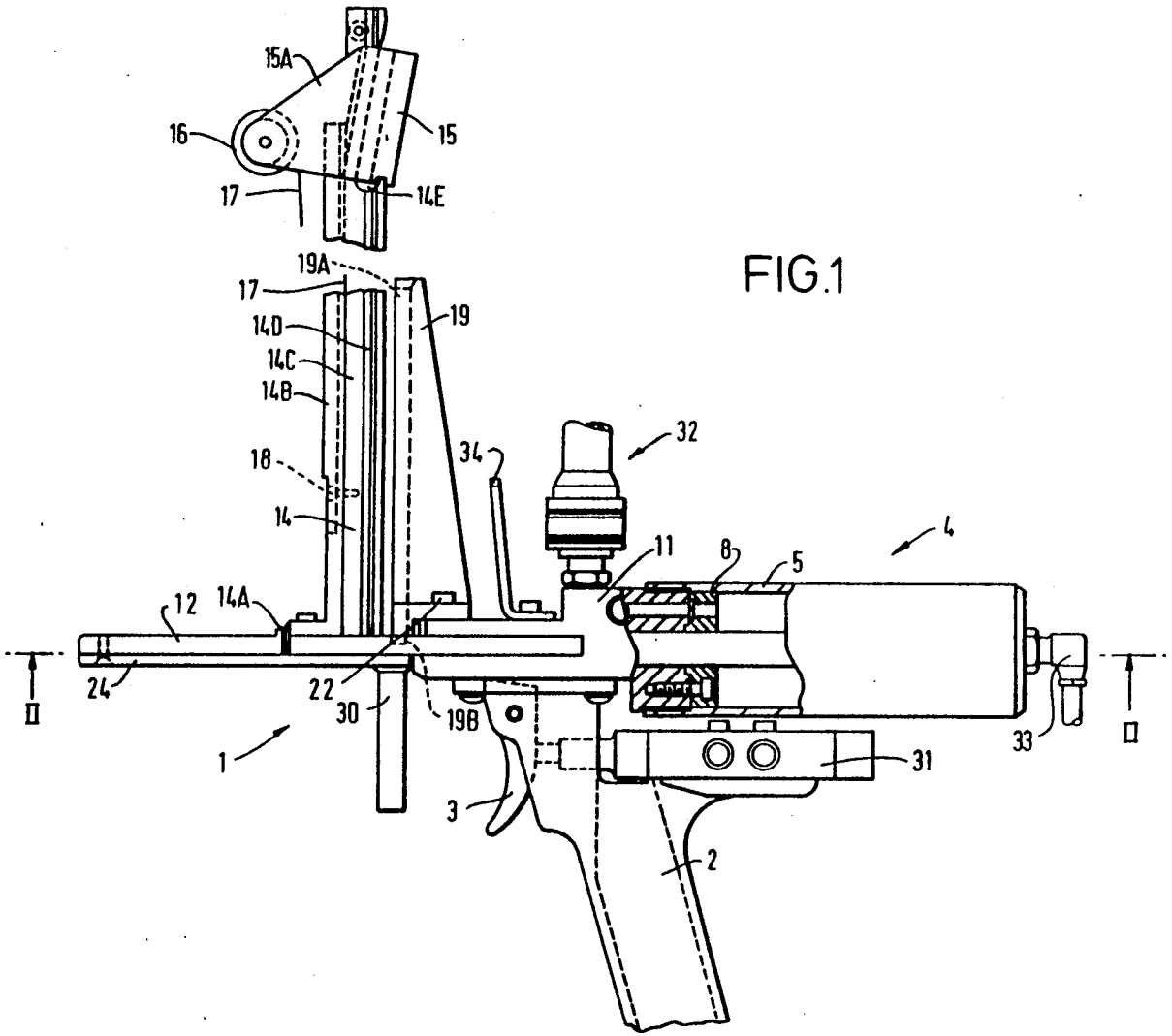
Figure 2:
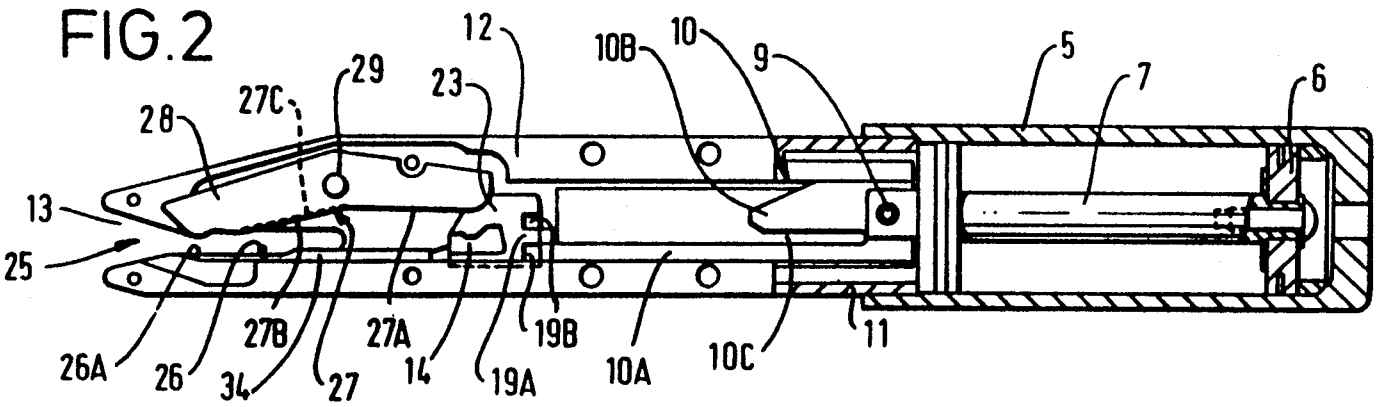
Figure 4:
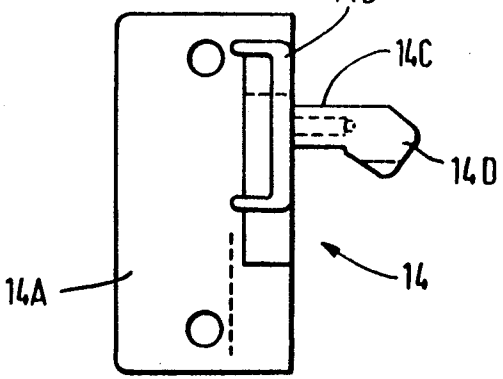
Figure 3:
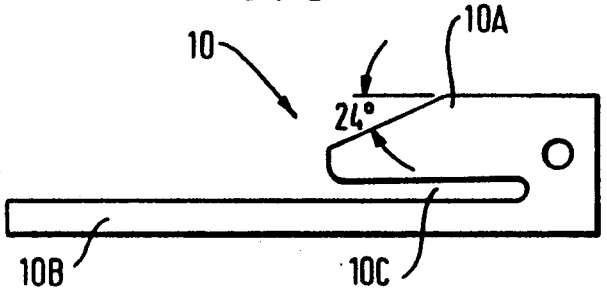
Figure 5:
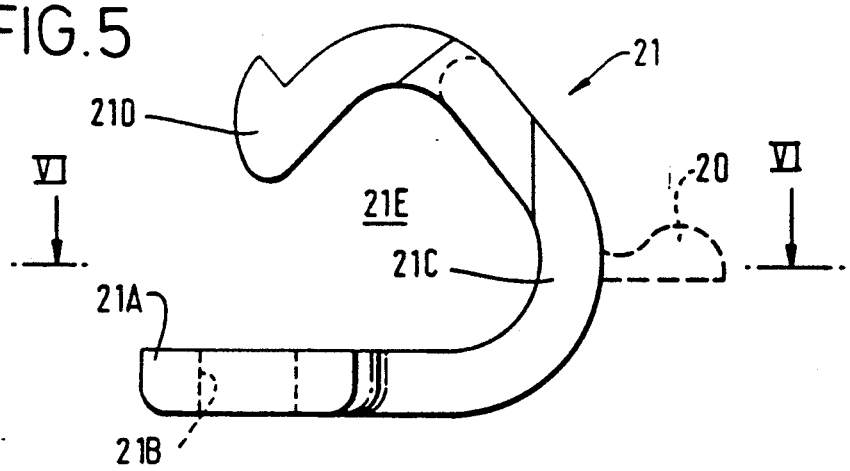
Figure 6:
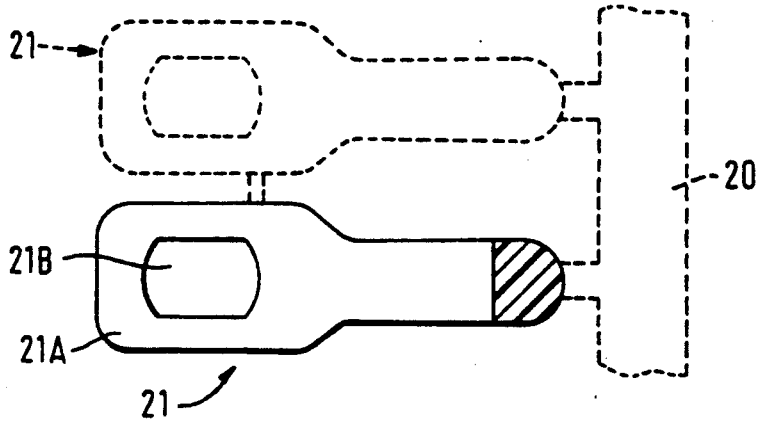
Figure 7:
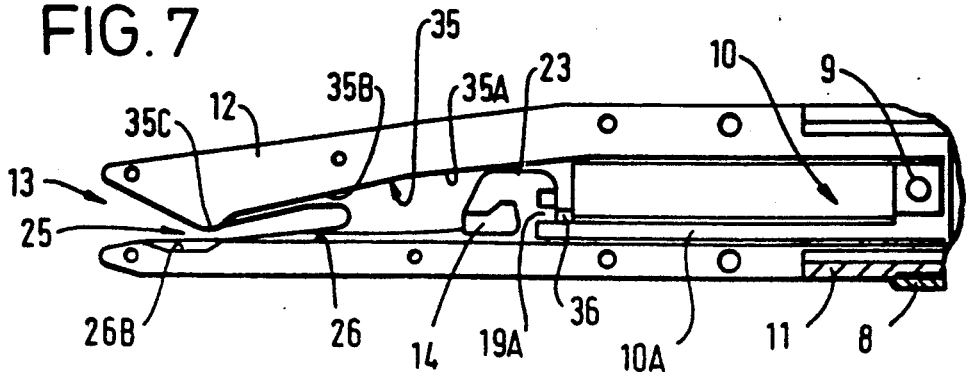

According to the present there is provided clip securing apparatus for securing clips of plastics materials around filamentary, stranded or strip-like materials, the apparatus having a throat for receiving materials to be secured together, a holder for a plurality of clips, and a reciprocal driver operable to remove clips one at a time from the holder and to drive each clip in open condition through the throat of the apparatus so that the materials to be secured together enter the clip, the throat having opposed faces that act upon the clip as it passes through the throat to close the clip around the materials and so secure the clip around the materials For a better understanding of the invention and to show how the same may be carried into effect, reference will now be made, by way of example, to the accompanying drawings, in which:

FIG. 1 is a side view, partly broken away and in section of a clip securing apparatus, FIG. 2 is a sectional view of the apparatus of FIG. 1, taken on line II—II in FIG. 1, FIG. 3 shows a driver of the apparatus, FIG. 4 is an end view on a larger scale of a clip guide rail of the apparatus, FIG. 5 is a side view of a clip that can be secured by the apparatus, FIG. 6 is a view of the clip of FIG. 5 taken on line VI—VI in FIG. 5 and showing also a further clip and a sprue interconnecting the clips, and FIG. 7 is a sectional view taken in the same direction as FIG. 2 but on a larger scale of part of a modified form of the apparatus.

The apparatus of FIGS. 1 and 2 is in the general form of a hand gun 1 having a hand grip 2, a trigger 3 and a body 4.

The rear part of the body 4 is formed by a cylinder 5 in which there is a piston 6 carried by a piston rod 7 that projects forwardly from the piston 6 and out of the front end of the cylinder 5 through a seal plate 8. At its front end, outside the cylinder 5, the piston rod 7 has secured to it, by a pin 9, a bifurcated driver 10. The two fingers 10A, 10B of this driver 10 (see also FIG. 3) project forwardly from the rear end of the driver 10 where the driver is secured to the piston rod 7. The finger 10A is an elongated, straight finger of constant narrow width throughout its length. The finger 10B is a wide finger that tapers down to nearly a point at its free end. This finger 10B is much shorter than the other finger 10A. The fingers 10A, 10B are separated by a slot 10C.

In its fully withdrawn position shown in FIG. 2 the driver 10 is within a spigot 11, which forms the central part of the body 4 and to which the hand grip 2 and cylinder 5 are secured.

The body 4 also includes an elongated frame 12 that is carried by the spigot 11, projecting forwardly therefrom. At its free end this frame 12 terminates in an open mouth 13.

To the upper face of the frame 12, near the spigot 11, there is secured a clip holder and guide rail 14 which projects upwardly from the body 4. As shown best in FIG. 4, this guide rail terminates at a base 14A by which it is secured to the frame 12. Throughout its length from the base 14A the guide rail consists of a U-channel 14B carrying a strip 14C along the free edge of which there is an enlarged bead 14D. Near the free end of the guide rail the bead 14D terminates at a notch 14E. When in a parked position, shown in FIG. 1, a bias member 15 is engaged in this notch 14E.

The bias member 15 is of saddle formation and is mounted on the guide rail 14 so that its horns 15A embrace the guide rail. A spool 16 fitted between the horns 15A has a tension spring 17 wound thereon which is stretched from the spool to near the base 14A of the guide rail, where it is anchored at 18 to the guide rail so that the action of the spring is to draw the bias member 15 along the rail towards the rail base 14A when disengaged from the notch 14E.

Secured to the spigot 11 so as to be parallel with and close to the guide rail 14 is a sprue guide 19. This sprue guide 19 has a groove 19A along its length that is open towards the bead 14D of the guide rail 14 and that receives a sprue 20 (FIGS. 5 and 6) of a strip of clips 21 that are of plastics material produced together with the sprue 20. In addition to being secured by screws 22 to the spigot 11, the sprue guide 19 has two lugs 19B which are entered in a window 23 in the frame 12 and which define between them the end portion of the groove 19A so that this groove extends into the window 23 in the frame 12. The clip holder and guide rail 14 is aligned with this window 23.

To the lower face of the frame 12 there is secured a cover 24 which closes the window 23 and which defines with the frame 12 a guideway for the driver 10 to move in and along which individual clips 21 pass, driven by the driver. The opposing faces of the frame 12 and cover 24 define two opposite faces of a throat 25 of the gun 1. The remaining two opposite faces of the throat 25 are defined by an internal edge face 26 of the frame 12 and the opposing edge face 27 of a bell crank lever 28 pivoted to the frame 12 at a pivot 29.

Carried by the cover 24 is a sprue guide tube 30 which projects from the cover 24 in the direction away from the sprue guide 19, this tube being aligned with the groove 19A of the guide 19.

The trigger 3 is disposed to operate a spool valve 31 which is connected via pipework and internal drillings in the spigot 11 to a compressed air line coupled at a quick release coupling 32 to the spigot 11. Two air lines pass from the spool valve 31, one to the rear of the cylinder 5 to enter the cylinder 5 via a coupling 33 to provide a power stroke of the piston 6, and the other via internal drillings in the spigot 11 and seal plate 8 for a return stroke of the piston 6.

A support bracket 34 by which the gun 1 as a whole can be hung from a supporting chain during use is secured to the spigot 11 rearwards of the sprue guide 19.

The clips 21 which are to be secured by operation of the gun 1 are, as mentioned above, formed as a strip of several clips (for example 20) formed on a sprue 20 (FIGS. 5 and 6). The clips are identical and each comprises a foot 21A with a through hole 21B a C-shaped leg 21C extending from the foot 21A (and attached to the sprue 20 at approximately the apex of its curve), and a barb 21D at the other end of the leg 21C, this barb in the unused condition of the clip being directed generally towards the hole 21B but spaced therefrom. In this unused condition the foot 21A, leg 21C and barb 21B define an open throat 21E.

In use of the gun 1 the bias member 15 is pulled off the clip holder and guide rail 14 and two strips of clips 21 are mounted on the guide rail so that the clips are held by the rail. The lengths of the strips are such that the first extends along the major part of the sprue guide 19 with its sprue 20 entered in the groove 19A of the sprue guide 19, this set leaving open a free end portion of the groove 19A so that the leading portion of the sprue of the second set of clips can also be engaged in the groove 19A. The bias member 15 is replaced on the guide rail 14 where it engages, at a position past the notch 14E, the end of the second set of clips and thereby spring bias is applied to both sets of clips. This bias urges the leading clip only of the first set of clips through the window 23, clear of the end of the guide rail 14.

The gun 1 is offered up to two or more pieces of filamentary, stranded or strip-like materials to be secured together so that these materials enter the throat 25 via the mouth 13 to remain there while the gun 1 is operated. The trigger 3 is depressed to operate the spool valve 31 to supply compressed air to effect a power stroke of the piston 6. Operating pressure is 6.2±0.69 Bar (90±10 p.s.i.) with a minimum flow rate of 7080cc/s (15c.f.m.). The driver 10 is driven forwards.

In a single stroke the first action of the driver 10 is that the leading end of its longer finger 10A strikes the leading clip 21 which has passed through the window 23, breaks this clip from the sprue 20 and pushes this clip along the guideway that is formed between the frame 12 and the cover 24. Towards the end of this travel the clip 21 receives in its open throat 21E the materials that are to be secured together. In the initial part of its travel the clip 21 moves between opposing parallel faces of the gun throat 25 which are formed by the internal edge face 26 of the frame 12 and a first portion 27A of the opposing edge face 27 of the lever 28.

Beyond the first portion 27A, the edge face 27 of the lever 28 continues with a portion 27B that is inclined towards the frame edge face 26, the edge face 26 being straight over the major part of its length. Thus the inclined face portion 27B and the opposing portion of the edge face 26 between them define a narrowing in the throat 25 as the throat approaches the mouth 13. As the clip 21 is driven through this narrowing portion the barb 21D is forced towards the foot 21A so as to begin to close the clip 21 about the material that has entered its throat 21E. To maintain stability of the clip during the final part of its movement along the gun throat 25 the edge face 26 of the frame 12 is at the base of a shoulder 34 of the frame 12, and the clip is also engaged in a groove 27C in the face portion 27B of the lever 28. The shoulder 34 and the groove 27C serve to support the clip.

Towards the end of its travel along the gun throat 25 the foot 21A of the clip 21 engages a ramp 26A at the end of the frame edge 26 so that the foot is moved towards the barb 21D. As the foot 21A reaches the ramp 26A the shorter finger 10B of the driver 10 strikes one end of the lever 28 which rides along the taper of this finger which is acting as a cam so that the lever 28 is forced to pivot about its pivot 29 and the other end of the lever 28 is forced towards the ramp 26A. There is this produced a closing of the throat 25 which ensures a positive location of the clip barb 21D in the clip hole 21B as the clip is gripped between the lever 28 and the ramp 26A. The clip is this secured around the materials entered in its throat 21E.

The trigger 3 is released and the valve 31 changes-over so that a return stroke of the piston 6 takes place. As the driver 10 retracts the lever 28 is freed for rotation to permit removal of the closed clip and the materials to which it has been secured. As the driver clears the end of the guide rail 14 the bias member 15 is able to assert itself so that the next clip 21 is presented for use.

As the clips continue to be used the part of the sprue 20 from which the used clips have been removed enters the support tube 30, which acts as an extension of the sprue guide 19, so that additional support is provided as the clips are broken off the sprue. This support is the only support provided for the sprue when the last clip on the sprue is broken off It will be appreciated that as each complete set of clips is used up a further set is placed on the guide rail 14 after first removing the bias member 15.

Turning to FIG. 7, in the modified form of the apparatus therein illustrated the shorter driver finger and the pivotable lever which this finger acts upon are omitted and the face of the gun throat 25 opposite that defined by the frame internal edge face 26 is defined by a further internal edge face 35 of the frame 12. The ramp at the end of the frame edge face 26 is also omitted. A guide block 36 is provided on the frame 12 to support the single finger driver 10 during its driving stroke.

In the form of FIG. 7 from the region of the window 23 in the direction towards the mouth 13 of the gun 1 a first portion 35A of the edge face 35 is inclined at a first angle towards the opposing edge face 26. This first portion 35A is followed by a second portion 35B which is inclined at a second, steeper angle towards the opposing edge face 26. The edge face 35 terminates at a nib 35C projecting towards the opposing edge face 26. This opposing edge face 26 is straight as far as opposite the nib 35C. Beyond the nib 35C the edge face 26 terminates in a recess 26B.

Operation of the form of FIG. 7 is as already described save that each clip 21 is closed by the action thereupon of the opposing faces 26 and 35 which in this form are stationary with respect to one another throughout their entire length. In this form the foot 21A moves along an entirely straight path until closure has been completed, the barb 21D being forced towards the foot 21A at first by the face portion 35A and then at an increasing rate by the portion 35B. Full engagement of the barb 21D in the hole 21B is effected as the clip is forced past the nib 35C. Thereafter the now closed and secured clip moves into the recess 26B and hence can be withdrawn from the gun 1.

A particular use of the apparatus that has been described is in the assembling of the component parts of plastics netting.

I-claim:

1. Clip securing apparatus for securing clips of plastics materials around filamentary, stranded or strip-like materials, the apparatus having a throat for receiving materials to be secured together, a holder for a plurality of clips, and a reciprocal driver operable to remove clips one at a time from the holder and to drive each clip in open condition through the throat of the apparatus so that the materials to be secured together enter the clip, the throat having opposed faces that act upon the clip as it passes through the throat to close the clip around the materials and so secure the clip around the materials, wherein one of said opposed faces of the throat is straight throughout the major part of the length of the throat, the other is a face of a pivotable lever tapering towards the one face so that the throat becomes narrower towards its mouth, and the driver is bifurcated having a first finger and a second finger shorter than the first finger in the direction of movement of the driver to drive the clip; the first finger in a single stroke of the driver effecting the removal of a clip from the holder and the driving of the clip through the throat, and the second finger in the last part of this single stroke acting on the lever to pivot the lever in the sense to close the throat and hence close the clip.

2. Clip securing apparatus as claimed in claim 1, wherein at its end that is at the mouth of the throat said one of said opposed faces terminates in a ramp directed towards the lever for ensuring full closure of the clip, the lever being freed to pivot away from this ramp upon return stroke of the driver to permit a closed clip to be removed from the throat.

3. Clip securing apparatus for securing clips of plastics materials around filamentary, stranded or strip-like materials, the apparatus having a throat for receiving materials to be secured together, a holder for a plurality of clips, and a reciprocal driver operable to remove clips one at a time from the holder and to drive each clip in open condition through the throat of the apparatus so that the materials to be secured together enter the clip, the throat having opposed faces that act upon the clip as it passes through the throat to close the clip around the materials and so secure the clip around the materials, wherein said opposed faces are stationary with respect to one another, one of said opposed faces being straight throughout the major part of the length of the throat and the other tapering towards the one so that the throat becomes narrower towards its mouth, said other of these faces having a first portion remote from the mouth of the throat that is inclined in the direction towards the mouth of the throat at a first angle towards said one face and which is followed by a second portion inclined towards said one face at a second angle steeper than the first angle, this second portion terminating at a nib projecting towards said one face for ensuring full closure of the clip; said one face terminating beyond the nib in a recess to permit a closed clip to be removed from the throat.

4. Clip securing apparatus as claimed in any one of claims 1 to 3, wherein the holder comprises a guide rail on which a strip of clips carried by a sprue can be mounted for movement along the rail towards the driver in a direction transverse to the direction of clip driving movement of the driver, the apparatus further including a sprue guide extending parallel to the guide rail for receiving said sprue, the driver breaking each clip from the sprue as it removes the clip from the rail.

5. Clip securing apparatus as claimed in claim 4 and including a further sprue guide disposed to be an extension of the first-mentioned sprue guide to receive that part of the sprue from which clips have been broken off.

* * * * *